US005846056A

United States Patent [19]

Dhindsa et al.

[11] Patent Number: 5,846,056

[45] Date of Patent: Dec. 8, 1998

[54] RECIPROCATING PUMP SYSTEM AND METHOD FOR OPERATING SAME

[76] Inventors: Jasbir S. Dhindsa, 1239 Sugar Creek Blvd., Suga Land, Tex. 77478; Leroy M. Rambin, Jr., 20309 Meadow Tree Court, Spring, Tex. 77388

[21] Appl. No.: 418,761

[22] Filed: Apr. 7, 1995

[51] Int. Cl.[6] ..... F04B 49/06

[52] U.S. Cl. ..... 417/44.2; 417/53; 73/152.22; 73/152.52

[58] Field of Search ..... 417/1–6, 12, 32, 417/45, 44.2, 53, 205, 208, 286, 292, 904, 269, 270, 271, 44.3; 91/472, 473; 92/12.2; 73/152.22, 152.51, 152.52

[56] References Cited

U.S. PATENT DOCUMENTS

| | | | |
|---|---|---|---|
| 3,847,507 | 11/1974 | Sakiyama et al. | 417/22 |
| 4,060,716 | 11/1977 | Pekrul et al. | 364/576 |
| 4,244,274 | 1/1981 | Oguni | 91/308 |
| 4,334,832 | 6/1982 | Brown et al. | 417/218 |
| 4,390,321 | 6/1983 | Langlois et al. | 417/53 |
| 4,535,326 | 8/1985 | Mullins et al. | 340/679 |
| 4,699,570 | 10/1987 | Bohn | 417/6 |
| 4,913,624 | 4/1990 | Seki et al. | 417/2 |
| 5,094,192 | 3/1992 | Seiffert et al. | 123/41.15 |
| 5,197,787 | 3/1993 | Matsuda et al. | 303/10 |
| 5,251,440 | 10/1993 | Bong-dong et al. | 60/329 |
| 5,259,731 | 11/1993 | Dhindsa et al. | 417/3 |
| 5,307,288 | 4/1994 | Haines | 364/510 |

*Primary Examiner*—Timothy Thorpe
*Assistant Examiner*—Xuan M. Thai
*Attorney, Agent, or Firm*—Madan & Morris, PLLC

[57] ABSTRACT

This invention provides a reciprocating pump system having means for determining the cylinder head pressure of at least one cylinder of each pump in the system. A control circuit continually determines the average cylinder head pressure, estimates the pump bearing life that has been consumed and the remaining pump bearing life from the pressure head information. The control circuit also controls the operation of the pumps as a function of cylinder head pressure. A temperature sensor coupled to the pump system provides temperature of the pump oil. The control circuit controls the operation of the pump as function of the pump oil temperature. The pump speed is decrease when the pump oil temperature exceeds a predetermined value. A vibration sensor coupled to the pump provides vibration level to the control circuit, which controls the pump operation in response thereto.

33 Claims, 6 Drawing Sheets

RECIPROCATING PUMP SYSTEM AND METHOD FOR OPERATING SAME

BACKGROUND OF THE INVENTION

1. Field of the Invention

This invention relates generally to large reciprocating pumps and more particularly to reciprocating pump systems wherein the pressure in a cylinder of a pump is utilized to automatically control operation of any or all of the pumps in the pump system and to provide information about various operating parameters of the pump system.

2. Description of the Related Art

Electrically operated, large reciprocating pumps (usually having a capacity of 750 horse-powers or greater) are commonly used in various applications. For example, such pumps are used: in the oil and gas industry to pump a fluid (generally a mixture of mud, oil, water and mineral additives, collectively referred to herein as the "mud") into an oil well during drilling of the well; at pump stations in the oil pipelines; for pumping fluid or slurry in coal and mining industries; and for pumping fluid and/or water in sewage treatment plants.

For convenience and not as a limitation, the description provided herein relates to the pumps used in the oil and gas industry. It will be noted, however, that the discussion provided herein and the present invention are equally applicable to reciprocating pumps used for other applications.

In the oil and gas industry, two or three pumps are most commonly used in parallel to a pump fluid into the borehole and typically each such pump contains three cylinders, each cylinder containing a reciprocating piston therein. A prime mover coupled to the pistons via a crank shaft moves (strokes) the pistons in their respective cylinders. Variable speed a.c. induction motors, d.c. motors, diesel/gasoline engines, hydraulic systems or the like are used as prime movers. However, d.c. motors and a.c. induction motors are most often used as the prime movers. When d.c. motors are used, a silicon control rectifier ("SCR") based control system, often referred to as a "drive," is commonly used to regulate electric power to the d.c. motors to operate the pumps. For convenience and not as a limitation, the discussion provided herein, unless otherwise specified, relates to d.c. motors and SCR control drives. Additionally, since majority of the pumps contain three cylinders the description provided herein relates to such pumps.

The pump systems currently used typically contain a pump stroke counter (gauge), pressure gauge coupled at the output of the pump, which provides the average pressure at the fluid outlet, and a pop-off valve installed at the common manifold, which opens and relieves the pressure if the fluid outlet pressure is above a preset cut-out or threshold pressure of the pop-off valve. Flow gauges are sometimes provided to determine the fluid flow from the pump system into the borehole. Some times the above-noted system parameters are displayed on display panels. An operator, using the displayed information and his experience, schedules the pumps for maintenance, determines when a pump is malfunctioning and endeavors to control the operation of the pumps. Such manual methods are difficult, inefficient and inadequate to control the operation of the pumps and to provide accurate information about operating conditions of the pumps so that the pumps may be scheduled for maintenance and repairs at optimal times and to avoid damage to the pumps and costly shut-down of the drilling operations. A mud pump may cost between $100,000–400,000 and any damage to such a pump can be very expensive and any down time during drilling operation can cost several thousand dollars for each hour of down time.

Each cylinder of the pump typically contains a replaceable liner, which must be replaced after a certain amount of use. Pump manufacturers do not specify the useful life of the liners and there exists no accurate method to continuously determine the condition of the piston liners. It is not uncommon to replace the liners either too early or in some cases when other parts of the pump have been damaged. It is, therefore, highly desirable to have a pump system which continuously provides information about the cumulative number of piston strokes over a predetermined time period to determine when to replace the piston liners.

Reciprocating pumps generally utilize radial or thrust type bearings, and their operating life is a function of the load on the piston rod (the "piston load") and the pump speed. Pump manufacturers specify the useful life of the bearings in what is referred to as the "L-10 hours", which are the minimum rated hours at full piston load and full speed for which the bearings are expected to work before a failure will occur. The actual operating hours are generally between 125,000–150,000 hours.

It is known that the pump bearing life is inversely proportional to an exponential power of the piston load. A heavy load for even a relatively short period of time can reduce the total bearing life considerably. In practice, the pumps operate under variable loads and speeds and, therefore, in order to determine the bearing life that has been consumed and/or the estimated remaining operating life, it is necessary to first continually determine the piston load and pump speed to calculate the bearing life. Currently, the bearing life is typically estimated based on visual inspection of the pump and the pump history. Such methods are not very reliable and cause the pumps to be refurbished either too early or in some cases after the pump has failed. Thus, there exists a long felt yet unsolved need to more accurately estimate the bearing life that has been consumed and the remaining bearing life.

Additionally, if a cylinder of a pump is not operating effectively or it is not operating at all, such as when its discharge valve is malfunctioning and it remains at least partially open at all time, no method exist to accurately determine the existence of such a condition in the prior art pump systems. It is, therefore, highly desirable to have a pump system which will continuously provide information about the operating condition of the pump cylinders.

During operation, the pump is continuously supplied with a fluid from a source (reservoir) at relatively low pressure (20–40 psi) by a centrifugal pump. If air is present in the fluid, it causes a condition in the pump known as "cavitation." Cavitation reduces the pump efficiency and often causes the pump to knock and in some cases it can damage the pump. Consequently, need exists to continuously monitor the pumps to determine if cavitation is present and to provide warning to the operator about the existence of such a condition and, if desired, to reduce the pump speed or to shut down the pump to avoid damage to the pump.

Presently, the pump systems typically contain a flow meter, which determines the volumetric output from the entire pump system. The flow meter does not provide accurate information about the volumetric fluid output from each pump in a multiple pump system. Such information is useful in determining if each pump is operating efficiently and if a particular pump is malfunctioning.

It should be obvious from the above discussion that in the presently used reciprocating pump systems, an operator looks at certain system parameters, such as the average pump output pressure, speed of the motors driving the pumps, the time for which the pumps have been operational and in response thereto controls the operation of the pumps and schedules pumps for maintenance work and repairs.

In addition to the above deficiencies of the presently used pump systems, there exists a need to continuously determine the temperature of the oil used in pumps and to automatically reduce the pump speed when the oil temperature is above a predetermined value to avoid damage to the pumps. The prior art pump systems neither provide such information nor do they automatically control the pump operation when such an adverse condition arises.

Also, it is desirable to control the pump operation when there is excessive vibration in the pump system, which may be due to poor installation of the pump system or due to a malfunction in the pump system.

In general, need exists to have a pump system which continuously provides adequate information about the cylinder head pressure (including the discharge pressure and suction pressure), average cylinder head pressure, estimates of pump life consumed and the remaining life, whether or not a pump is malfunctioning, the cumulative number of strokes, pump oil temperature and pump vibration level, and output volume of each pump so that the operation of the pump system may be better managed and to activate alarms when certain adverse conditions occur and additionally to automatically control the operation of the pumps under certain operating conditions.

The present invention provides a pump system which continuously displays information about various system parameters, activates audio alarms when certain system parameters fall outside predetermined norms and automatically controls the operation of the pumps when certain system parameters fall outside their respective predetermined limits. The system of the present invention also eliminates the need for several sensors which are presently used to provide information about the system parameters.

SUMMARY OF THE INVENTION

The present invention provides a reciprocating pump system wherein a pressure sensor is placed at a suitable place in at least one cylinder of a pump in the pump system. A control circuit utilizing the cylinder head pressure determines values of certain system parameters, controls the operation of the pump system in accordance with programmed instructions, and activates alarms if the values of certain system parameters fall outside their respective predetermined norms. The system parameters computed by the control circuit include the average cylinder head pressure, volumetric output form each pump in the system, load on the pistons of the pumps, strokes per unit time, and the cumulative number of strokes over a time period. The control circuit also estimates the pump bearing life that has been consumed and the remaining pump bearing life. The control circuit also controls the operation of the pumps as a function of the cylinder head pressure.

A temperature sensor coupled to the pump system provides temperature of the pump oil. The control circuit causes the pump speed to decrease when the pump oil temperature exceeds a predetermined value and/or activates an alarm. A vibration sensor coupled to the pump provides vibration level of the pump system, which is used by the control circuit to decrease the speeds of the pumps and/or to activate an alarm or to shut down the pumps.

Examples of the more important features of the invention thus have been summarized rather broadly in order that detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DESCRIPTION OF THE PREFERRED EMBODIMENT

Figure 1C:
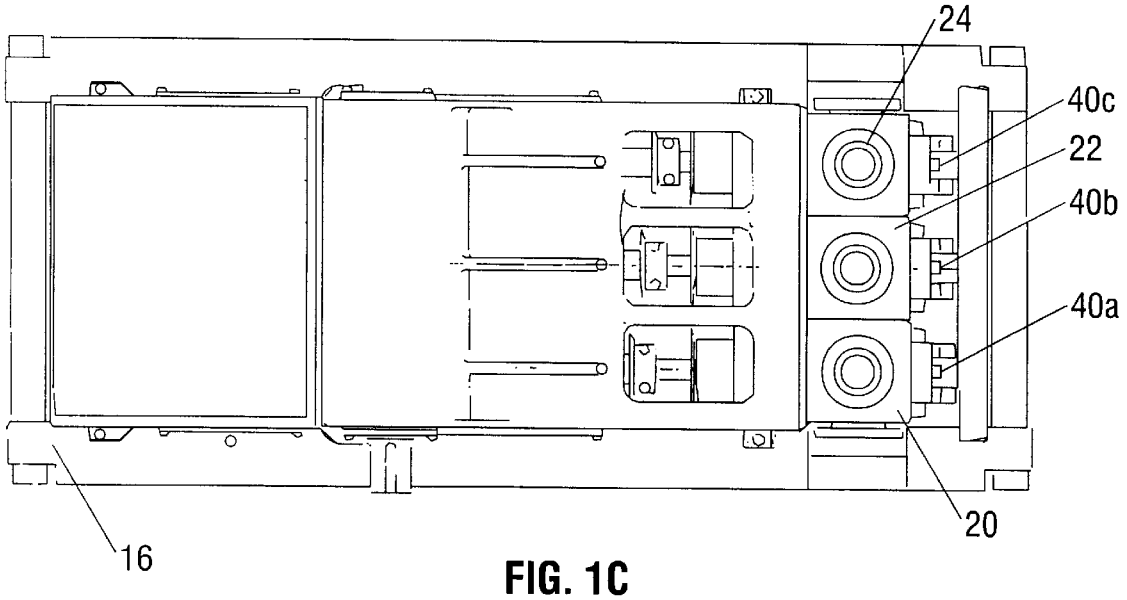
FIG. 1*c* shows a plan view of the reciprocating pump of FIG. 1*a*.
Figure 1A:
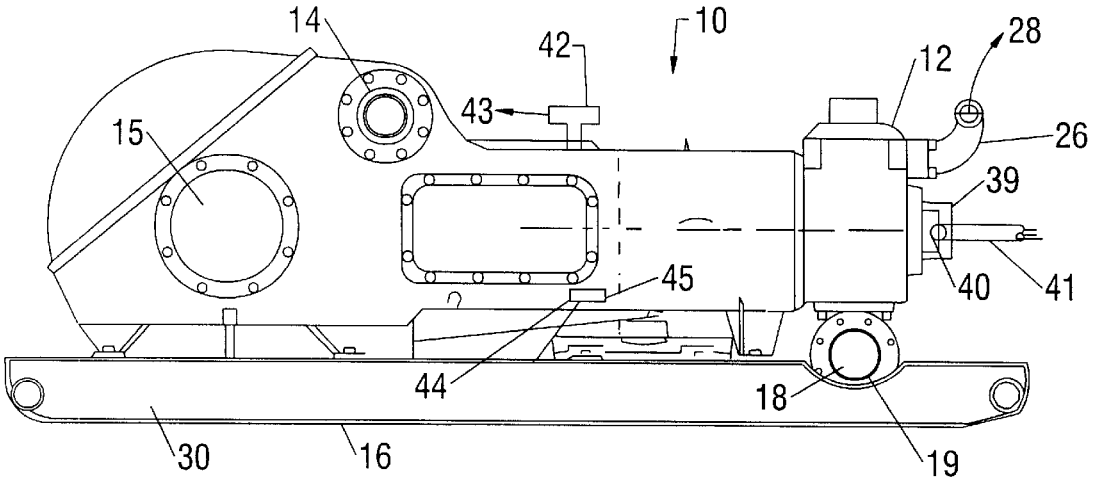
FIG. 1*a* shows a schematic elevational view of a reciprocating pump having a pressure sensor, temperature sensor and vibration sensor placed thereon according to the present invention.
Figure 1B:
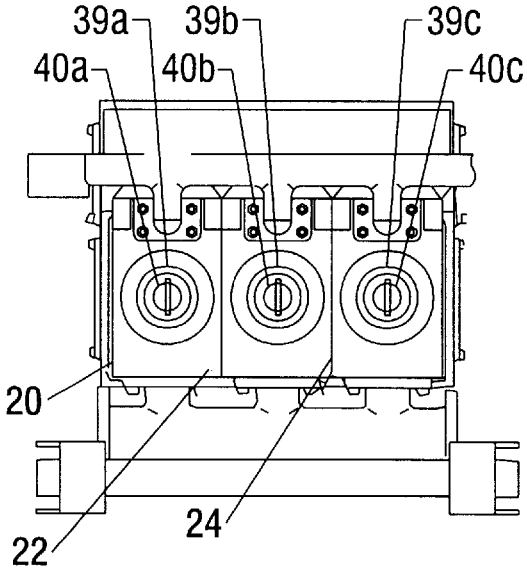
FIG. 1*b* is a side view of the reciprocating pump of FIG. 1*a*.

FIG. 1*a* shows a schematic elevational view of a reciprocating pump 10 placed on a skid 16, FIG. 1*b* is a schematic side view of the pump of FIG. 1*a*, and FIG. 1*c* shows a schematic plan view of the pump of FIG. 1*a*. Referring to FIGS. 1*a*–1*c*, the pump 10 contains a pump section 12 having cylinders 20, 22 and 24, each such cylinder having therein a reciprocating piston. A prime mover 14 (preferably an electric motor) coupled to the pistons via a crankshaft moves (strokes) the pistons in their respective cylinders. A centrifugal pump 19 supplies a fluid, at a relatively low pressure (typically between 20–40 psi), from a source (not shown) into a pump intake 18. The cylinders discharge the fluid 28 at a high pressure, typically between 3000–5000 psi, into a common outlet 26. The pump contains 10 bearings 15 and other mechanical elements. A reservoir within the pump 10 is filled with a suitable working oil 30 that is continuously circulated to lubricate various mechanical elements of the pump 10 when the pump is operating.

Each cylinder of the pump section 12 has a cylinder head. Cylinder heads 39*a*, 39*b* and 39*c* are respectively associated with cylinders 20, 22 and 24. In one embodiment, a pressure sensor 40*a* is preferably placed in the cylinder head 39*a* of the cylinder 20. Similarly, if desired, pressure sensors 40*b* and 40*c* respectively may be placed in the cylinder heads 39*b* and 39*c*. The pressure sensors are mounted in a manner that will ensure that they continuously provide signals representative of the pressure in their associated cylinders (cylinder head pressure). Alternatively, pressure sensors may be placed at the end of the piston rods or the plungers or in the body of the fluid end or at some other described location. Electrical conductors, such as conductors 41, coupled to the pressure sensors are appropriately routed and coupled to a control circuit (see FIG. 5) for processing the sensor signals. The operation of the control circuit is described later in reference to FIG. 5.

A temperature sensor 44, placed at a suitable place in the pump system, provides signals representative of the temperature of the oil 30. The outgoing arrow 45 is shown to indicate that the signals from the temperature sensor are transmitted to the control circuit.

A vibration sensor 42, preferably affixed to a suitable place on the pump 10, such as the body of the pump, provides signals representative of the vibration level of the pump. The outgoing arrow 43 is shown to indicate that the vibration sensor signals are passed to the control circuit, which processes such signals to provide information about the vibration level of the pump 10.

Figure 2:
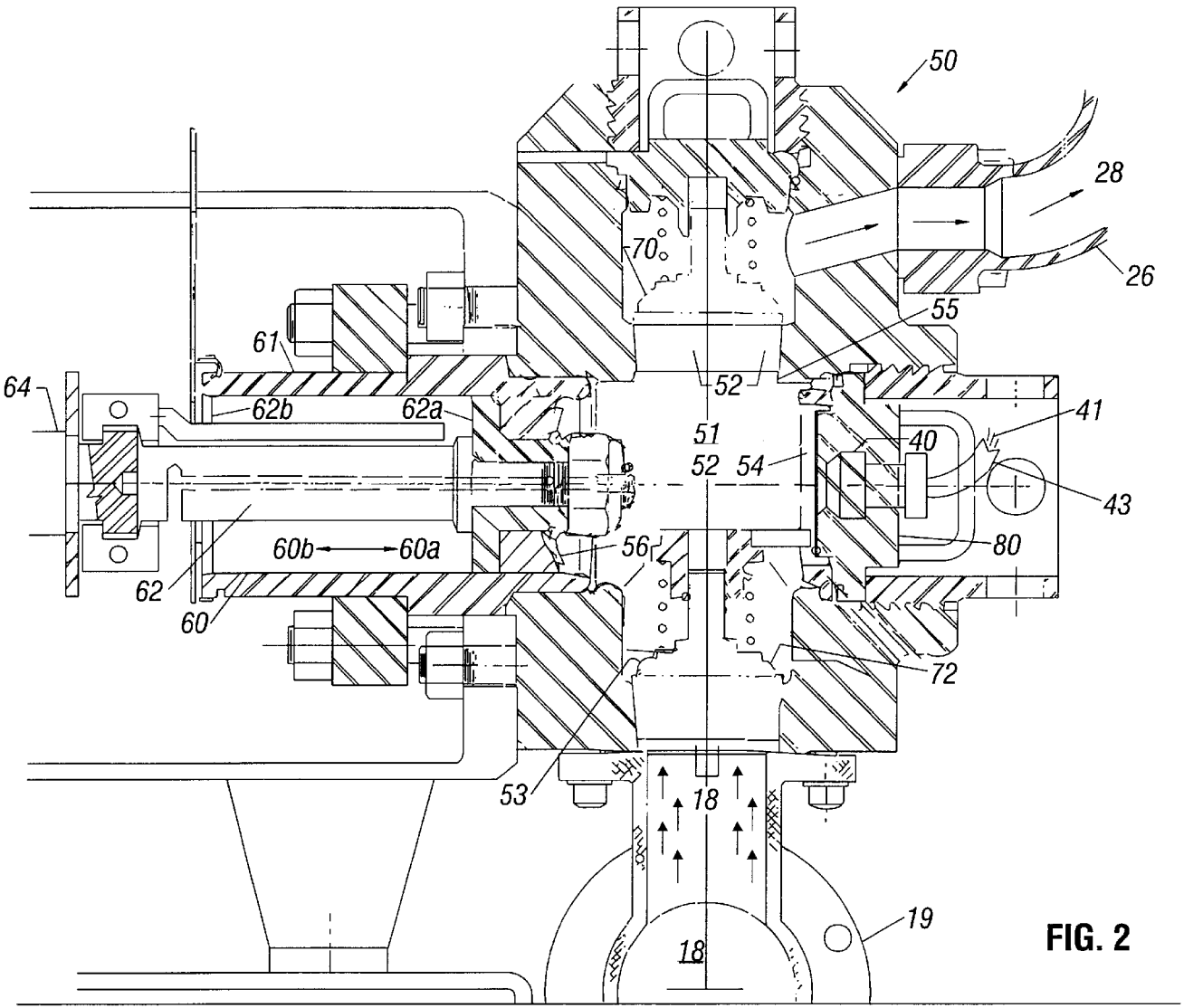
FIG. 2 shows a cross-section view of a cylinder of the pump shown in FIG. 1*a*.

FIG. 2 shows a partial sectional view of a pump cylinder 50 of the pump shown in FIGS. 1*a*–1*c*. The pump cylinder shown in FIG. 2 contains a chamber 51 having a cavity 52 in fluid communication with a piston cylinder 60. One end of the cavity 52 defines a cylinder head 54, which is preferably open to the outside. A cylinder head plug 80 having a through passage 76 therein is securely placed at the cylinder head 54 to seal the cavity from the outside environment except through the passage 76. A second end of the cavity 52 defines a piston end 56. A piston 62 placed in the piston cylinder 60 is adapted to reciprocate (stroke) within the piston cylinder 60 between a front end 62*a* of the piston cylinder and a back end 62*b* of the piston cylinder. A prime mover, preferably a d.c. motor, coupled to the piston 62 via a suitable rod member 64, moves the piston 62 within the cylinder 60 between the front end 62*a* and back end 62*b*.

A suction valve 72 (also referred to herein as an intake valve) is sealingly placed at a first side 53 of the cavity 52 while a discharge valve 70 is similarly placed at a second side 55 of the cavity 52. A pressure sensor 40 is securely placed in the cylinder head plug 80 such that the pressure sensing element of the pressure sensor 40 is open to the passage 76 and is, thus, in direct fluid communication with the cavity 52. Electrical conductors 41 coupled to the pressure sensor 40 are securely placed in a casing or conduit 43, such as a flexible hose, for carrying the electrical conductors 41 to the control circuit, whose operation, as indicated before, is described later in reference to FIG. 5.

During operation of the pump 10, the centrifugal pump 19 coupled to the suction valve 72 supplies a fluid to the cylinder chamber 51 at a relatively low suction pressure (typically between 20–40 psi) from a reservoir (not shown) via the intake 18. Arrows 18*a* indicate the fluid flow path from the centrifugal pump 19 to the cylinder chamber 52.

For purposes of this invention, a piston cycle or stroke is defined as containing a suction cycle (when the piston 62 moves from the front end 62*a* to the back end 62*b*) and a discharge cycle (when the piston moves from the back end 62*b* to the front end 62*a*). During a suction cycle, the discharge valve 70 remains closed and the piston 62 moves from the front end 62*a* to the back end 62*b*. Since the centrifugal pump is operating, the fluid pressure causes the suction valve 72 to remain open, thereby filling the cavity 52 and the piston chamber 60 with the fluid. The pressure in the cylinder chamber 51 remains near the low pressure during the entire suction cycle.

During the discharge cycle, the piston 62 starts to move from the back end 62*b* toward the front end 62*a*, which compresses the fluid in the cylinder chamber 51, which causes pressure in the cylinder chamber 51 to rise substantially instantaneously, due to the fact that fluids are substantially incompressible. When the pressure in the cylinder chamber 51 (referred herein as the cylinder head pressure) exceeds the back pressure on the discharge valve 70, it opens, causing the fluid 28 to flow from the cavity 52 into an outlet 26, as shown by the arrows 52*a*. All of the cylinders of a pump typically discharge fluid in to a common outlet, such as the outlet 26, at a relatively high pressure, which is typically greater than 3000 psi. The speed of the piston 62 is greatest and the discharge pressure is at a peak when the piston near the middle of its associated cylinder. During operation, this process of filling the piston chamber 60 with the fluid at a relatively low suction pressure and discharging it into the pump outlet 26 at a relatively high discharge pressure repeats several times a minute, typically between 60–140 times per minute.

Since the pressure transducer 40 is in fluid communication with the fluid in the chamber 51, it continuously provides signals representative of the actual cylinder head pressure. As noted earlier, a pressure sensor is placed in at least one cylinder of each pump. However, a separate sensor may be placed in any cylinder of the pump if it is desired to determine the cylinder head pressure for that cylinder.

FIGS. 1*a*–1*c* and 2 show one embodiment of the placement of the pressure sensors, i.e., at the cylinder head. The cylinder head pressure may be obtained from any other suitable place, such as by placing a pressure sensor at the piston rod or the plunger.

Figure 3:
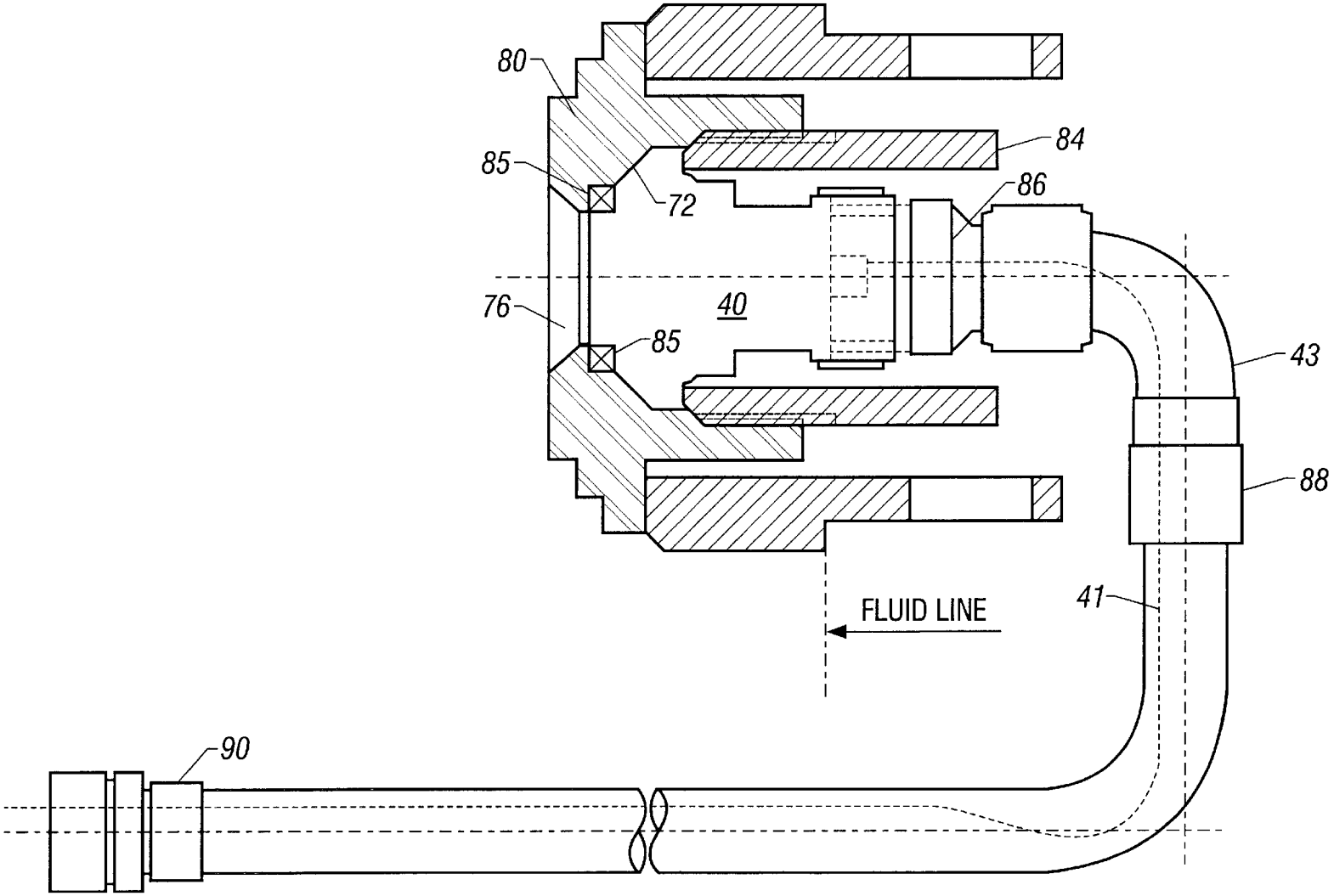
FIG. 3 shows a partial cross-section of a cylinder of the pump of FIG. 1*a* showing the placement of a pressure sensor according to one embodiment of the present invention.

FIG. 3 shows a partial sectional view of the cylinder head plug 80 showing a preferred manner of placing the pressure sensor 40 therein. The cylinder head plug 80 has a hollow chamber terminating into a through hole 76 of suitable dimensions. The inside of the hollow chamber, terminating at the passage 76, is shaped to suitably accommodate the pressure sensor 40. Pressure sensors typically have a tapered front end with a pressure sensing area thereon. The inside of the cylinder head plug chamber 80 is preferably made to snugly accommodate the tapered end 77 of the pressure sensor 40. A suitable seal 85 is placed between the pressure sensor 40 and the cylinder head plug 80 to provide a seal between the cavity 52 and any outside environment. A lockout member 84, screwed in the cylinder head plug 80, securely places the pressure sensor in the cylinder head plug 80.

For the protection of electrical conductors 41 and for safety reasons, the electrical conductors 41 coupled to the pressure sensor 40 are preferably run inside a flexible hose or conduit 43 that terminates into a connector 90, which is then coupled to the control circuit. Since the pressure sensor 40 is in direct fluid communication with the cylinder chamber 51 via the passage 76, it continuously provides signals to the control circuit that are represented of the actual cylinder head pressure. The cylinder head pressure during operation changes from a relatively low suction pressure during the suction cycle to a relatively high discharge pressure during the discharge cycle, as described below in more detail.

Figure 4:
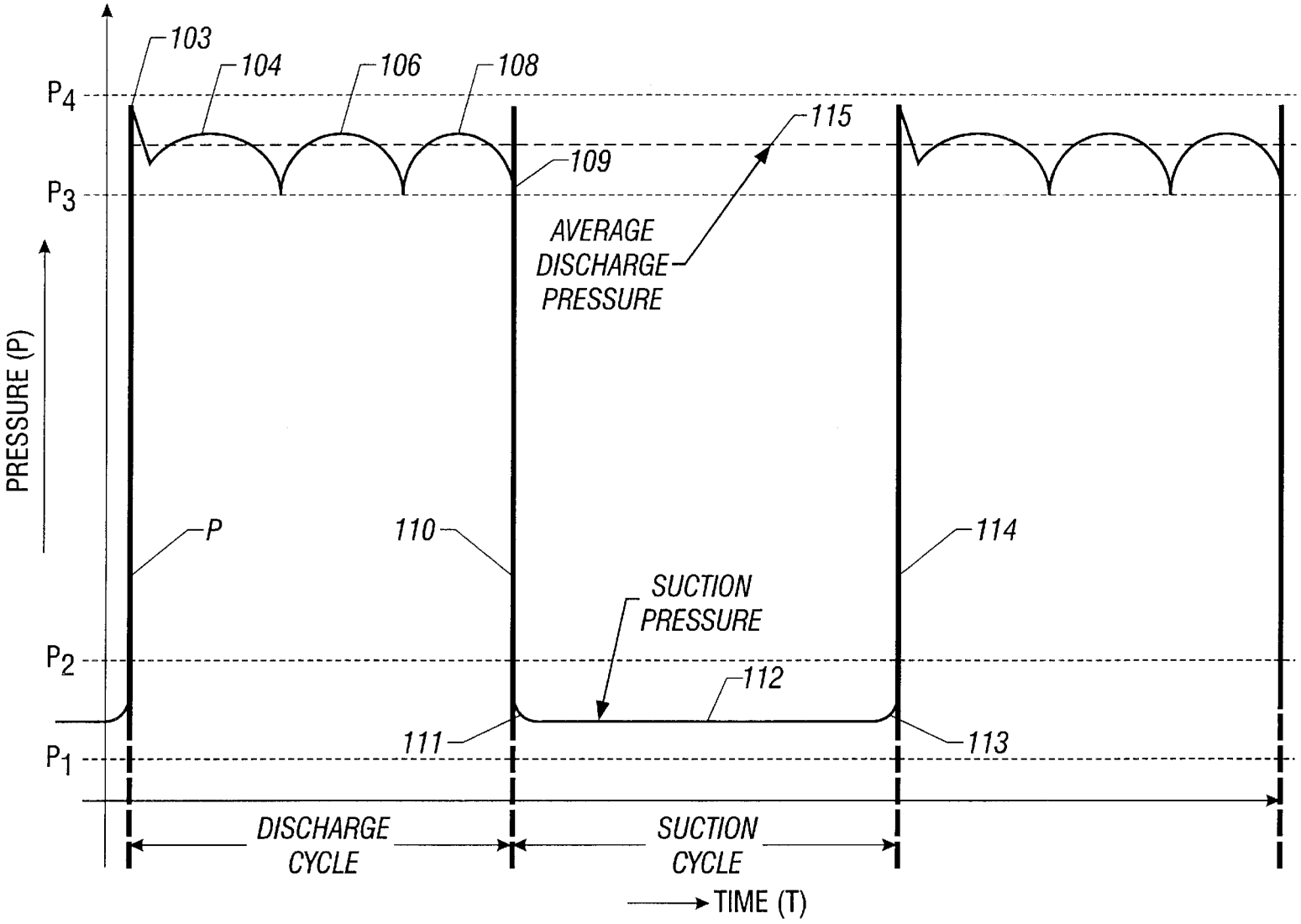
FIG. 4 is a graph showing typical cylinder head pressure of a triplex-reciprocating pump.

FIG. 4 shows a graph of a typical cylinder head pressure P as a function of time "T." In FIG. 4, the pressure P is shown along the vertical or the y-axis, while the time T is shown along the horizontal or the x-axis. Prior to the beginning of a discharge cycle, the cylinder head pressure P is at a relatively low value as shown by point 100 (typically between 20–40 psi as discussed earlier), which is the centrifugal pump outlet pressure.

As the piston starts to move inward, i.e., at the beginning of a discharge cycle, the cylinder head pressure P rises substantially instantaneously (unless the fluid contains air pockets) from the low pressure at point 102 to a high pressure as shown by point 103, due to the fact that fluids are substantially incompressible. When the cylinder head pressure exceeds the back pressure on the discharge valve 70, it opens and the fluid from the cylinder chamber 51 starts to flow from the cylinder chamber 51 into the outlet 26. As discussed earlier, each pump typically has three cylinders, which operate with a phase shift of ⅓ (one-third) of the pump cycle. The cylinder head pressure of any of the pistons is not constant, but typically exhibits a number of local peaks, such as shown by points 104, 106 and 108 on the pressure curve. During the discharge cycle, the discharge pressure under normal conditions, however, remains within a high pressure range defined by the pressure limits P3 and P4. A triplex typically exhibits the pressure curve shown in FIG. 4. At the end of the discharge cycle, point 109, the piston's speed is zero and the discharge valve closes.

At the beginning of the suction cycle, the piston starts to move outward, thereby creating a vacuum in the cylinder chamber 51, which causes the cylinder head pressure to drop rapidly as shown by segment 110 to a low value, as shown by point 111, which lies between a low pressure range defined by the limits P1 and P2. During the suction cycle, the suction valve opens causing the fluid to fill the cylinder chamber 51. The cylinder head pressure P remains low during the entire suction cycle as shown by the segment 112. At the beginning of the next discharge cycle at point 113, the cylinder head pressure P rises again as shown by the segment 114 and the pressure curve repeats as shown in FIG. 4.

The pressure curve P shown in FIG. 4 is typical for a triplex pump operating under normal conditions. The pressure curve signature will differ from this when the pump is malfunctioning. For example, if the discharge valve associated with a cylinder remains completely open or partially open during the suction cycle, the cylinder head pressure will remain high at all times and the suction valve will not open. This malfunction will be detected easily if a pressure sensor is placed in the malfunctioning cylinder for it will show a high pressure during the entire suction cycle. If however, a sensor is placed in a cylinder that is operating normally, the malfunction may readily be determined by electronically comparing the actual pressure response curve to the normal response curve for that pump, which may be stored in the control circuit.

As noted earlier, the signals from all of the sensors (pressure, temperature and vibration sensors) used in the pump system of the present invention pass to a control circuit which processes such signals to provide information about various operating conditions of the pump system: by displaying certain information; by activating audio/visual alarms when certain system parameters fall outside their respective predetermined values; and controls the operation of the pumps by controlling the speed of the prime movers, and thus, the speed of the pumps. The elements and operation of the control circuit will not be described in detail.

Figure 5:
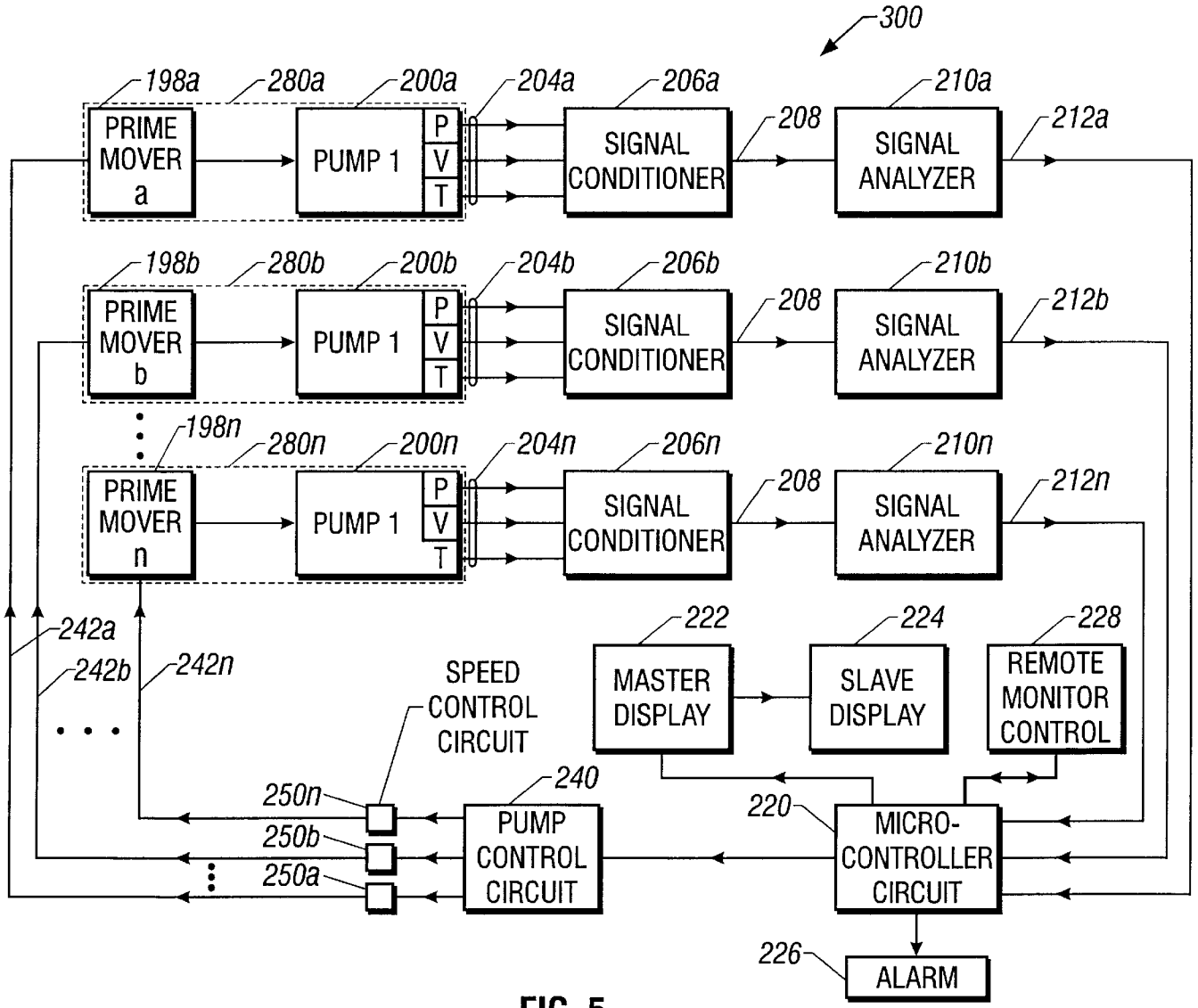
FIG. 5 shows a block circuit diagram of a control circuit for controlling the operation of reciprocating pumps according to the present invention.

FIG. 5 shows a functional block diagram of an embodiment of a control circuit 300 according to the present invention. The control circuit 300 is shown to be coupled to multiple pumps 280*a*–280*n*, each such pump respectively including a pump section 200*a*–200*n* and an associated prime mover 198*a*–198*n*. It is preferred that at least one cylinder of each pump contain a pressure sensor in the manner described earlier. However, in some applications, it may be more desirable to place pressure sensors in more than one cylinder of a pump. The control circuit 300 described here is equally applicable to such variations, which are considered obvious design choices. For convenience, and not as a limitation, the explanation given below generally relates to a system wherein one piston of each pump contains a pressure sensor. The control circuit 300 receives signals (information) from the various sensors associated with each pump and in response thereto continuously displays information about various operating parameters for each such pump, activates alarms when certain abnormal conditions are detected and automatically controls the operation of each such pump according to programmed instructions. Although the control circuit 300 is shown coupled to "n" pumps, it however, may be used to independently control only a single pump.

The signals from pressure sensors, temperature sensors, and vibration sensors associated with each of the pumps 280*a*–280*n* respectively pass to their associated signal conditioners 206*a*–206*n* via conductors 204*a*–204*n*. Each signal conditioner generally preamplifies the received sensor signals and filters any excessive noise associated with such signals. The conditioned signals from the signal conditioners 206*a*–206*n* pass to their associated signal analyzer circuits 210*a*–210*n*, which are adapted to perform such functions as frequency analysis of the pressure signals to determine the differences, if any, between the actual pressure signals and a predetermined reference pressure signature.

The signals from the signal analyzers 210*a*–210*n* are passed to a microcontroller circuit 220, which controls the operation of the pumps according to programmed instructions. The microcontroller circuit 220 contains, among other things, a microprocessor, digital to analog converters, memory elements, input/out circuitry and various other elements. The microcontroller circuit performs various computations and control functions in accordance with programmed instructions, which may be provided from an external source, such as a monitor and control computer 228 and/or stored in the memory associated with the microcontroller circuit 220. The memory preferably contain a read only memory ("ROM") to store instructions and random access memory ("RAM") in which data maybe stored and from which data may be read by the microprocessor.

A display 222, coupled to the microcontroller circuit 220, displays information about various system parameters of the pumps 280*a*–280*n* and any other desired information. An alarm 226, preferably an audio alarm, coupled to the microcontroller circuit 220 is activated by the microcontroller circuit 220 to alert the operator when certain abnormal operating conditions relating to a pump are detected by the microcontroller circuit 220. A remote monitor and control 228 may be coupled to the microcontroller circuit 220 for remotely providing instructions to the microcontroller circuit 220 and for displaying information about the operating conditions of the pumps.

The microcontroller circuit 220 is coupled to a pump control circuit 240, which is preferably an SCR drive having speed control circuits 250*a*–250*n* associated with the pumps 280*a*–280*n*, for controlling the speed of the prime movers 198*a*–198*n*. The use of SCR drives and microcontroller circuits is known in the art of electrical engineering and, thus, circuits relating thereto, are not described in detail herein. For a multiple pump system, such as shown in FIG. 5, the microcontroller circuit performs predetermined operations or calculations for each pump in the system and displays certain desired information for various pumps in the system. For convenience and not as a limitation, the operation of the control circuit 300 of FIG. 5 will now be described with respect to the pump 280*a*. The description given below however, is equally applicable to the other pumps 280*b*–280*n*. The operation is first described with respect to the pressure sensor and then with respect to the temperature sensor and vibration sensor respectively.

The microcontroller circuit 220 receives conditioned pressure sensor signals representative of the cylinder head pressure of pump 280*a*. The microcontroller circuit 220 determines the number of strokes per unit time period (for example a minute) from the pressure signals. The microcontroller circuit 220 may be programmed to compute the number of strokes by determining the beginning of each discharge cycle, i.e., when the pressure rises from the suction pressure at point 102 to the discharge pressure at point 103 (FIG. 4) or it may be programmed to count the strokes by determining when the suction cycle begins, i.e., when the cylinder head pressure drops from the discharge pressure (high pressure), such as at point 109, to the suction pressure (low pressure), such as at point 113, or by using some other logic using the suction head pressure. The microcontroller circuit 220 is also programmed to cumulate the number strokes for the pump 280*a* from the last time when the piston liners were changed and/or the time when the pump was first made operational or from some other desired reference point. The number of strokes per unit time and the cumulative number of strokes for the pump may be displayed on the display 222 and the remote monitor and control 228 and/or documented on paper. Such information is useful to schedule the pump 280*a* for maintenance and to replace the liners when the pump has been operating for a predetermined number of strokes. The microcontroller circuit 220 also may be programmed to flash the cumulative number of strokes on the display 222 and the remote monitor and control 228 and/or activate the alarm 226 when the pump has been operating for a certain number of strokes so as to provide a warning to the pump operator. The microcontroller circuit may also be programmed to provide a signal to the pump control circuit 240 to shut down the pump if the pump has been operating for a predetermined maximum allowable number of cumulative strokes.

Since the displacement volume of each piston cylinder is known, the microcontroller circuit 220 may easily be programmed to calculate the output volume for the pump 280*a*, which is the product of the number of strokes over a time period and the piston displacement volume of all piston of the pump 280*a*. The pump discharge volume may be displayed on the display 222 and the remote monitor 228.

The microcontroller circuit 220 also determines the average discharge pressure (as shown by the line 115, FIG. 4) for the pump 280*a* from the actual pressure curve, such as curve P shown FIG. 4 of the pump 280*a* and displays it on the display 222 and monitor and control 228. If the average discharge pressure for the pump is above a predetermined value, which will normally indicate that there is excessive back pressure on the discharge valve, it will indicate that there is a drilling related problem. If such a condition exists, the microcontroller circuit 220 may be programmed to activate the alarm 226 and/or to cause the pump control circuit to reduce the speed of the pump 280*a* by reducing the speed of its associated prime mover 198*a* or to completely shut down the pump.

Additionally the microcontroller circuit 220 determines the value of each local peak pressure and if the value of any such peak is above a maximum value, it will activate the alarm 226 and may be programmed to reduce the pump speed or to shutdown the pump.

As noted earlier, it is known that the pump bearing life depends upon the piston load and the pump speed and that the piston load is directly related to the cylinder head pressure. The pump bearing life may be specified as "h" hours at "q" psi of cylinder head pressure and "s" speed. The pump systems currently being used generally have devices to determine the total hours for which the pump has been operating, the average speed and the average manifold pressure, but do not provide the cylinder head pressure. A heavy load on the pump pistons, for even a relatively short period of time, can reduce the total bearing life considerably. Since the pumps operate at variable loads and speeds, the bearing life can be considerably different for different pumps. As noted earlier, there does not exist method to continuously and automatically determine with any certainty the pump bearing life that has been consumed and the estimated remaining bearing life. Furthermore, it is a common practice to replace the bearings based on visual inspection and/or when the pump has been running for a certain time period. Such methods do not provide information to optimize the pump use and the bearings are either replaced too early, which adds unnecessary maintenance costs, or in some cases after the pump has been damaged, which may result in unscheduled down time, which can cost several thousand dollars per hour of down time in addition to the cost of repairing the pump. The present invention provides a method for continually determining the bearing life that has been consumed and the estimated remaining bearing life from information provided by the pressure sensor coupled to the pump.

Any method for determining the bearing life utilizing the cylinder head pressure may be used for the purpose of this invention. One such method is described below for the purposes of explaining the present invention and is not to be considered as the only such method or a limitation to the present invention. This method describes the method for determining the bearing life that has been consumed and the estimated remaining bearing life. It is known that the bearing life is inversely proportional to an exponential power of the applied load. For variable loads and speeds, the bearing life may be closely estimated by the following formula:

$$Lt = \frac{S1 + S2 + S3 + \ldots Sn]}{Lp1\ Lp2\ LP3 \ldots LPn}$$

Where

Lt=total life in hours

S=portion of total operating life that bearing is under constant load, expressed as a decimal (S=S1+S2+ . . . Sn must equal 1.0)

Lp Life in hours for each period of constant load and speed found by computing a "Life Factor" (Lf) and reading the life in hours from appropriate life scale for the type of bearing used, which are published by the pump or bearing manufacturers.

For radial bearings, the life factor may be computed from:

$$L_f = \frac{BDTC \times SF \times RF}{P} \text{ or } L_f \frac{BDTC \times SF \times SF}{Pe}$$

$$L_f = \frac{BDTC \times SF}{T} \text{ or } L_f \frac{BDTC \times SF}{Te}$$

The values for BDC, SF and RF depend upon the type of bearings used (for example, radial bearings, thrust bearings, etc.) and are provided by the pump or bearing manufacturers.

From the pressure information provided by the pressure sensor, the microcontroller circuit 220 computes the loads at various combinations of pressures and speeds. It then calculates the life factor for each such load using the applicable formula given above.

The life in hours for each period of constant load and speed is then obtained from a look-up table stored in the memory associated with the microcontroller circuit 220. The fractional values of S1–Sn are determined from the time intervals already computed by the microcontroller 220. Using the values of S1–Sn and Lp–Ln, the total life in hours is calculated, which provides the bearing life that has been consumed. The microcontroller 220 is programmed to continually calculate the consumed life as described above from the time of the most recent replacement or refurbishing of the bearings. The estimated remaining life is merely the difference between the expected or specified life by the manufacturer or any other predetermined value and the consumed life.

The microcontroller circuit 220 may be programmed to display the consumed bearing life, the estimated remaining life on the display 222 and the monitor and control 228. It may be programmed to activate the alarm 226 and/or to cause the pump control circuit 240 to shut down the pump via the speed control circuit 250*a* when the consumed bearing life has reached a predetermined value.

With respect to the temperature sensor signals, the microcontroller circuit 220 continually determines the oil temperature from such signals. The oil temperature is displayed on the display 222 and the monitor 228 and if the oil temperature is above a predetermined value, the microcontroller circuit 220 causes the pump control circuit 240 to reduce the pump speed by reducing the energy supply to its associated prime mover, for example prime mover 198*a* for pump 280*a*, until the oil temperature falls below a predetermined value. The microcontroller also causes the pump to shut down if the oil temperature remains above a certain value for more that a specified time period. Such conditions are displayed on the display 222 and monitor 228 for use by the operator.

The microcontroller circuit 220 also receives the vibration signals from each of the vibration sensors pumps, from which it determines the vibration level for each pump and displays such values on the display 222 and monitor and control 228. If the vibration level of any pump is above a predetermined level, the alarm 226 is activated. The speed of any pump displaying excessive vibration may be reduced or such pump may be shut down until any malfunction has been corrected.

For practical reasons, override mechanisms may be provided for the operator for any of the above-noted conditions so that the operator may override any automatic control function of the control circuit of FIG. 5.

In summary, the reciprocating pump system of the present invention contains a pressure sensor in at least one cylinder of each pump in the system to provide information representative of the cylinder head pressure of its associated cylinder, a temperature sensor placed at a suitable place in each of the pumps to provide information representative of the temperature of the working oil in its associated pump and a vibration sensor to provide signals representative of the level of the vibration of its associated pump. A control circuit 300 containing a microcontroller circuit 220 and pump control circuit controls the operation of the pumps 280*a*–280*n*. The microcontroller circuit 220 utilizes the information provided by the pressure sensors and determines, among other things, the number of strokes per unit time, cumulative number of strokes from a reference time onward, the bearings life that has been consumed and the remaining life of the bearings. It also determines the temperature of the oil in the pumps and the vibration level of the pumps. The control circuit continuously displays the values of various system parameters and activates an alarm when certain system parameter values are outside their respective predetermined norms. The microcontroller circuit 220 also reduces the speed of any pump or completely shuts it down if the value of a defined system parameter of such pump falls outside a predetermined range.

The pump system of the present invention, thus, continuously provides critical information about the pumps to an operator utilizing information from sensors placed in the system and controls the operation of the pumps when certain adverse operating conditions are detected.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. A reciprocating pump, comprising:

(a) a pump cylinder for receiving a fluid at an inlet at a suction pressure and discharging the fluid at an outlet at a discharge pressure;

(b) a pressure sensor coupled to the pump cylinder for providing signals representative of pressure in the cylinder; and (c) a circuit coupled to the pressure sensor, said circuit receiving signals from the pressure sensor and utilizing such received signals to determine at least one operating parameter of the reciprocating pump selected from a group of parameters consisting (i) cavitation in the reciprocating pump, (ii) average pump cylinder pressure, (iii) the discharge pressure, (iv) the suction pressure, (v) pump operating cycle, (vi) pump speed, (vii) pump operating time, (vii) an estimate relating to consumed life of the reciprocating pump, (viii) an estimate relating to the remaining operating life of the reciprocating pump, and (ix) volumetric output of the reciprocating pump.

2. A reciprocating pump, comprising:

(a) a pump cylinder for receiving a fluid at an inlet at a suction pressure and discharging the fluid at an outlet at a discharge pressure;

(b) a piston in the pump cylinder, said piston adapted to move between a first and a second position, the movement of the piston from the first position to the second position defining a suction cycle and the movement from the second position to the first position defining a discharge cycle and a combination of a suction cycle and a discharge cycle defining a piston stroke;

(c) a pressure sensor coupled to the pump cylinder for providing signals representative of pressure in the chamber during the piston stroke; and (d) a circuit coupled to the pressure sensor for receiving signals from the pressure sensor, said circuit determining a pressure response curve from the received signals and determining therefrom an operating parameter of the reciprocating pump selected from a group of parameters consisting (i) cavitation in the reciprocating pump, (ii) average pump cylinder pressure, (iii) the discharge pressure, (iv) the suction pressure, (v) pump operating cycle, (vi) pump speed, (vii) pump operating time, (vii) an estimate relating to consumed life of the reciprocating pump, (viii) an estimate relating to remaining operating life of the reciprocating pump, (ix) volumetric output of the reciprocating pump, and (x) number of piston strokes over a predetermined time period.

3. The reciprocating pump according to claim 2, wherein the circuit further determines from the pressure response curve a mean discharge pressure in the pump cylinder.

4. The reciprocating pump according to claim 3, wherein the piston is operated by a motor and the circuit causes the motor to reduce speed of the pump when the mean discharge pressure reaches a predetermined upper limit.

5. The reciprocating pump according to claim 2, wherein the circuit further determines a peak pressure value of the discharge pressure during each stroke and causes the motor to reduce speed of the pump if such peak pressure reaches a predetermined value.

6. The reciprocating pump according to claim 2, wherein the circuit determines a pressure response curve from the pressure signals and compares such response curve with a predetermined pressure response curve to determine whether a cavitation condition is present in the pump.

7. The reciprocating pump according to claim 2, wherein the reciprocating pump contains a bearing whose operating life is a function of the number of the piston strokes and wherein the circuit provides an estimate of the operating life of the bearing that has been consumed.

8. The apparatus according to claim 2, wherein the circuit contains a microprocessor and a silicon control rectifier based circuit for controlling speed of the reciprocating pump.

9. The reciprocating pump according to claim 2, wherein the piston moves in a piston cylinder having a replaceable liner and the circuit determines from the pressure response curve an expected remaining life of the liner.

10. The reciprocating pump according to claim 2, wherein the pump cylinder comprises:

(i) a cylinder head; and (ii) a plug disposed In the cylinder head.

11. The reciprocating pump according to claim 10, wherein the pressure sensor is disposed in the plug.

12. The reciprocating pump according to claim 2, wherein the pressure sensor is coupled to the piston.

13. A reciprocating pump having a plurality of chambers, wherein each said chamber has an associated piston chamber in fluid communication with the chamber and wherein each said piston strokes within its associated chamber to cause the its associated chamber to receive a fluid from a source at a suction pressure and discharge the received fluid at a common outlet at a discharge pressure, said pump comprising:

(a) a pressure sensor coupled to a single chamber in said plurality of chambers for providing signals representative of pressure in such chamber; and (b) a circuit coupled to the pressure sensor, said circuit determining response of the pressure in the chamber to which said pressure sensor is coupled, said circuit determining from the response of said sensor in said single chamber at least one operating parameter of the reciprocating pump selected from a group consisting (i) cavitation in the reciprocating pump, (ii) average pump cylinder pressure, (iii) the discharge pressure, (iv) the suction pressure, (v) pump operating cycle, (vi) pump speed, (vii) pump operating time, (vii) an estimate relating to consumed life of the reciprocating, (viii) an estimate relating to the remaining operating life of the reciprocating pump, and (ix) volumetric output of the reciprocating pump, and (x) number of piston strokes over a predetermined time period.

14. A method of operating a reciprocating pump having a pump cylinder for receiving a fluid at a suction pressure and for discharging the fluid at a discharge pressure, said reciprocating pump having a piston reciprocating within a piston cylinder which is in fluid communication with the pump cylinder, each reciprocating cycle of the piston defining a pump stroke, said method comprising:

(a) providing a pressure sensor in the chamber for determining pressure in the chamber during operation of the reciprocating pump;

(b) operating the pump at a predetermined speed;

(c) determining from the pressure sensor response a pressure response curve of the reciprocating pump when the pump is operating, said pressure response curve having characteristics that include a leading edge, a discharge pressure region, a trailing edge, and a suction pressure; and (b) determining at least one operating parameter of the reciprocating pump by utilizing at least one of the characteristics of the pressure in the pump cylinder.

15. The method according to claim 14, wherein the at least one operating parameter of the pump includes number of piston strokes over a predetermined time period.

16. The method as described in claim 15, wherein the at least one parameter includes life of a piston liner in the reciprocating pump.

17. The method as described in claim 14, wherein the at least one parameter includes life of a pump bearing in the reciprocating pump.

18. The method of operating a reciprocating pump according to claim 14 further comprising:

(a) determining vibration level of the pump at a suitable place on the pump; and (b) reducing speed of the prime mover and thereby reducing the pump speed when the vibration level reaches a predetermined upper limit.

19. A pump system for use in pumping a fluid into a wellbore, comprising:

(a) a plurality of reciprocating pumps, each said pump in said plurality of pumps having a plurality of chambers, wherein each said chamber having an associated piston chamber in fluid communication therewith and wherein each said piston stroking within its associated piston chamber for causing its associated chamber to receive a fluid from a source at a suction pressure and discharging the received fluid at common outlet at a discharge pressure;

(b) a pressure sensor coupled to at least one chamber of each said pump in said plurality of pumps, each said pressure sensor providing signals representative of pressure in the chamber to which such pressure sensor is coupled; and (c) a circuit coupled to each of the pressure sensors, said circuit determining the pressure in each of the chambers to which a pressure sensor is coupled, said circuit providing information about at least one operating parameter of each of the pumps in said plurality of pumps that is selected from a group of parameters consisting of (i) cavitation in the reciprocating pump, (ii) average pump cylinder pressure, (iii) the discharge pressure, (iv) the suction pressure, (v) pump operating cycle, (vi) pump speed, (vii) pump operating time, (vii) an estimate relating to consumed life of the reciprocating pump, (viii) an estimate relating to the remaining operating life of the reciprocating pump, and (ix) volumetric output of the reciprocating pump.

20. A reciprocating pump, comprising:

(a) a pump cylinder for receiving a fluid at an inlet at a suction pressure and discharging the received fluid at an outlet at a discharge pressure;

(b) a piston in the pump cylinder, said piston adapted to move between a first and a second position, the movement of the piston from the first position to the second position defining a suction cycle and from second position to the first position defining a discharge cycle and a combination of a suction cycle and a discharge cycle defining a piston stroke;

(c) a pressure sensor coupled to the chamber for providing signals representative of pressure in the chamber during the piston stroke; and (d) a circuit coupled to the pressure sensor for receiving signals from the pressure sensor, said circuit determining from the received signals a pressure response curve for the reciprocating pump corresponding to the piston stroke and analyzing said pressure response curve to determine an operating parameter of the reciprocating pump.

21. The reciprocating pump according to claim 20, wherein the operating parameter is selected from a group of parameters consisting (i) cavitation in the reciprocating pump, (ii) average pump cylinder pressure, (iii) the discharge pressure, (iv) the suction pressure, (v) pump operating cycle, (vi) pump speed, (vii) pump operating time, (vii) an estimate relating to consumed life of the reciprocating pump, (viii) an estimate relating to the remaining operating life of the reciprocating pump, end (ix) volumetric output of the reciprocating pump, and (x) number of piston strokes over a predetermined time period.

22. The reciprocating pump according to claim 20, wherein the pressure response curve includes characteristics selected from a group consisting a leading edge rising from a suction pressure to a discharge pressure, a region of discharge pressure, a trailing edge dropping from the discharge pressure to the suction pressure and a suction pressure region.

23. The reciprocating pump according to claim 22, wherein the operating parameter is the discharge pressure and wherein the circuit determines the discharge pressure from the discharge pressure region of the pressure response curve.

24. The reciprocating pump according to claim 22, wherein the operating parameter is the suction pressure and wherein the circuit determines the suction pressure from the suction pressure region of the pressure response curve.

25. The reciprocating pump according to claim 22, wherein the operating parameter is average pump cylinder pressure and wherein the circuit determines the average pump cylinder pressure from the suction pressure region and the discharge pressure region of the pressure response curve.

26. The reciprocating pump according to claim 22, wherein (i) the operating parameter Is cavitation in the pump cylinder, and (ii) the circuit determines the cavitation by comparing the pressure response curve with a predefined pressure response curve provided to the circuit.

27. The reciprocating pump according to claim 22, wherein the operating parameter is number of pump strokes over a time period, and wherein the circuit determines the number of strokes by analyzing at least one characteristic associated with the pressure response curve.

28. The reciprocating pump according to claim 27, wherein the characteristic is selected from a group consisting (i) the leading edge, and (ii) the trailing edge.

29. The reciprocating pump according to claim 20, wherein the piston reciprocates within a piston cylinder having a replaceable liner whose operating life is a function of number of piston strokes.

30. The reciprocating pump according to claim 29, wherein the circuit computes cumulative number of strokes from the pressure response curve and determines an estimate of the remaining life of the liner as a function of the cumulative number of piston strokes.

31. The reciprocating pump according to claim 20, wherein the operating parameter is volumetric output of the reciprocating pump and wherein the circuit computes number of strokes from the pressure response curve and determines therefrom the volumetric output of the reciprocating pump.

32. The reciprocating pump according to claim 20, wherein the pump contains a bearing and wherein the circuit determines from the pressure response curve a physical condition of the bearing from the pressure response curve and programmed instructions provided to the circuit.

33. The reciprocating pump according to claim 20, wherein (i) the pump contains a piston liner, and (ii) the circuit determines from the pressure response curve a physical condition of the liner from the pressure response curve and programmed instructions provided to the circuit.

* * * * *